US006739083B2

(12) United States Patent
Martin

(10) Patent No.: US 6,739,083 B2
(45) Date of Patent: May 25, 2004

(54) RUNOUT CORRECTION RIFLE BARREL

(75) Inventor: James Martin, Spring, TX (US)

(73) Assignee: Bore Science Technologies, L.L.C., Spring, TX (US)

( * ) Notice: Subject to any disclaimer, the term of this patent is extended or adjusted under 35 U.S.C. 154(b) by 20 days.

(21) Appl. No.: 09/952,879

(22) Filed: Sep. 12, 2001

(65) Prior Publication Data

US 2004/0035043 A1 Feb. 26, 2004

(51) Int. Cl.[7] ..... F41A 21/00

(52) U.S. Cl. ..... 42/78; 89/14.05

(58) Field of Search ..... 42/77, 78, 79, 42/75.01, 76.1, 76.01; 89/14.05, 14.7; 102/444, 439

(56) References Cited

U.S. PATENT DOCUMENTS

| | | | | | |
|---|---|---|---|---|---|
| 14,597 | A | | 4/1856 | Buckel et al. | |
| 45,898 | A | | 1/1865 | Berdan | |
| 157,008 | A | | 11/1874 | Kerr | |
| 1,082,916 | A | | 12/1913 | Squire | |
| 1,177,983 | A | * | 4/1916 | Avis | 408/1 R |
| 1,290,840 | A | | 1/1919 | Maynard | |
| 1,355,421 | A | * | 10/1920 | Pedersen | 42/78 |
| 1,355,422 | A | * | 10/1920 | Pedersen | 42/76.01 |
| 1,450,558 | A | | 4/1923 | Delamare-Maze | |
| 1,944,883 | A | | 1/1934 | Gerlich | 42/76 |
| 2,293,114 | A | | 8/1942 | Carter | 29/1.1 |
| 2,541,115 | A | * | 2/1951 | Somes | 138/177 |
| 2,541,116 | A | * | 2/1951 | Somes | 138/177 |
| 2,924,149 | A | | 2/1960 | Musser | 89/1.7 |
| 2,963,943 | A | * | 12/1960 | Cutts | 42/79 |
| 3,054,329 | A | * | 9/1962 | Willig | 42/76.01 |
| 3,100,358 | A | * | 8/1963 | Robinson, Jr. | 42/78 |
| 3,261,121 | A | * | 7/1966 | Eves | 42/76.02 |
| 3,438,794 | A | | 4/1969 | Ritson et al. | 106/194 |
| 3,611,867 | A | | 10/1971 | Silsby | 89/14 |
| 3,643,364 | A | * | 2/1972 | Koch | 42/78 |
| 3,786,589 | A | * | 1/1974 | Kaltmann | 42/78 |

(List continued on next page.)

FOREIGN PATENT DOCUMENTS

| | | | | |
|---|---|---|---|---|
| EP | 0892238 A | | 1/1999 | |
| FR | 1.540 | * | 3/1868 | 89/8 |
| FR | 789828 | * | 4/1935 | 89/8 |
| FR | 1013781 | * | 8/1952 | 89/8 |
| FR | 2246834 A | | 2/1975 | |
| SU | 1723432 A1 | | 3/1992 | |

OTHER PUBLICATIONS

AR–15, M16 Assault Rifle Handbook; 1985 by Desert Publications.

W.W. Greener, *The Gun and Its Development*, Ninth Edition; (1881), pp. 252–262, 331–342.

Patrick Sweeney, *Gunsmithing: Rifles*, (1999) 105–125, 196–203, 209–214.

*Primary Examiner*—Michael J. Carone
*Assistant Examiner*—Denise J Buckley
(74) *Attorney, Agent, or Firm*—W. Allen Marcontell; Shawn Hunter

(57) ABSTRACT

A rifle barrel for realigning a projectile which is propelled through the barrel by gas pressure, the barrel comprising: a bore having a bore diameter through which a projectile may travel; rifling ridges within the bore; and at least one bore expansion chamber in the bore, wherein a diameter of the at least one bore expansion chamber is greater than the bore diameter, wherein a length of the at least one expansion chamber is smaller than an overall length of the projectile and greater than a contact length of the projectile. A process for projecting a projectile from a rifle barrel, the process comprising: increasing gas pressure behind the projectile in the rifle barrel, whereby the projectile is propelled through the rifle barrel; and passing a burst of gas around the projectile, whereby the projectile is aligned coaxially in the rifle barrel.

20 Claims, 6 Drawing Sheets

U.S. PATENT DOCUMENTS 3,845,581 A * 11/1974 Infantino ..... 42/76.01
4,047,466 A * 9/1977 Berman ..... 102/526
4,126,955 A 11/1978 Coffield, Jr. et al. ..... 42/78
4,176,847 A 12/1979 Akai et al. ..... 274/39
4,353,181 A * 10/1982 Pedgonay ..... 42/78
4,527,348 A 7/1985 Brennan ..... 42/76
4,590,698 A * 5/1986 Finn ..... 42/76.01
4,660,312 A 4/1987 A'Costa ..... 42/76.01
4,674,217 A 6/1987 Matievich ..... 42/76.01
4,722,261 A 2/1988 Titus ..... 89/7
5,060,552 A * 10/1991 Reynolds ..... 124/3
5,092,246 A * 3/1992 Huerta ..... 102/439
5,095,802 A * 3/1992 Reynolds ..... 124/3
5,183,958 A * 2/1993 Petrovich ..... 42/76.02
5,212,328 A * 5/1993 Petrovich ..... 42/76.02
5,305,678 A 4/1994 Talbot et al. ..... 89/14.3
5,394,634 A * 3/1995 Vang et al. ..... 42/79
5,452,535 A * 9/1995 See et al. ..... 42/79
5,623,780 A * 4/1997 Phillips, Jr. ..... 42/76.01
5,767,438 A * 6/1998 Lang et al. ..... 102/444
5,782,030 A 7/1998 French ..... 42/26.01
5,823,173 A 10/1998 Slonaker et al. ..... 124/56
5,841,058 A 11/1998 Manis ..... 89/8
5,950,608 A * 9/1999 Tidman ..... 124/1
6,065,384 A * 5/2000 Widder et al. ..... 102/520
6,085,630 A 7/2000 Manis ..... 89/8

* cited by examiner

RUNOUT CORRECTION RIFLE BARREL

BACKGROUND OF THE INVENTION

The present invention relates to firearms technology. In particular, the present invention concerns a rifle barrel having a bore configuration which projects a projectile in a highly accurate manner by correcting bullet runout without sacrificing muzzle velocity.

Various rifle bore configurations have been disclosed in the industry. Several examples are discussed below.

U.S. Pat. No. 4,527,348, incorporated herein by reference, discloses a gun barrel adapted to be connected to a receiver includes a rifled portion and a smoothbore portion. The rifled portion may have deeper than normal grooves to permit the escape of propellant gases past the bullet. The smoothbore portion includes an increased diameter expansion section, a reduced diameter compression section and an alignment section. Gases expanding past the bullet reduce the peak pressure in the gun barrel and provide a relatively low pressure adjacent to the muzzle at the time of bullet exit. The improved gun barrel affords increased bullet velocity and accuracy, and reduced felt recoil.

U.S. Pat. No. 4,590,698, incorporated herein by reference, discloses an improved barrel for a firearm or cannon wherein the muzzle velocity of the projectile fired is controlled by systematically bypassing around the projectile during its travel through the barrel of the weapon a portion of gases generated upon firing of the weapon.

U.S. Pat. No. 4,660,312, incorporated herein by reference, discloses a gun barrel having a rifled-bore section at the breech end thereof, the sections having a gas tight connection therebetween, the rifled-bore section comprising a first generally tubular body having a longitudinal bore and at least one spiral groove formed in the wall of the bore to a depth of a predetermined dimension, the rifled-bore section having a length corresponding substantially to the peak pressure point for the gun barrel, the smooth-bore section comprising a second generally tubular body having a longitudinal bore coaxial with the longitudinal bore of the rifled-bore section, and the longitudinal bore of the smooth-bore section having a diameter greater than the diameter of the bore of the rifled-bore section and less than the diameter of the spiral rifling groove.

U.S. Pat. No. 5,841,058, incorporated herein by reference, discloses the construction and arrangement of projectile bearing surface interfaces rearward and forward of a recessed surface chamber of the projectile interface conjointly with the interfaces of bore wall areas segmented by recessed bore chambers which in conjunction effect the deployment/transport/disbursement/development/modulation and transformation of explosive propellant charges sequentially primed and activated rearward and forwardly of the projectile along the bore and in bore wall chambers captively converting high static gas pressure to expansively relieved dynamic propellant gas pressure directly at the projectile reducing firearm barrel recoil while energizing projectile movement along the bore in a closed-system of thermodynamic propellant energy for free flight purposes.

When firing a bullet or projectile from a rifle bore, it is particularly important for the bullet to spiral or spin about its longitudinal axis as it leaves the muzzle. This ensures that the bullet will fly along a straight line through the air to impact its intended target. A problem arises when cartridges are loaded with a bullet wherein the bullet is misaligned relative to the casing. A casing having been loaded in this manner is said to have some degree of runout. For example, as shown in FIG. 1A, a side view of a casing 1 is shown, wherein the casing 3 and the bullet 2 are misaligned. The bullet tip 4 is off the casing longitudinal central axis 5 by a distance, called runout 6. It is much more preferred to have no runout, i.e., the bullet tip 4 is coaxial with the casing longitudinal central axis 5 as shown in FIG. 1B.

Typical, military grade ammunition will have some degree of runout for nearly every cartridge manufactured. For example, a typical .223 caliber cartridge will have runout of as much as 0.09 inches. Cartridges having runout will not produce an accurate shot when fired. When a cartridge is introduced into the breach of a gun, the casing 3 fits snuggly within the breach and therefore becomes coaxially aligned with the central axes of the breach and rifle bore. If the cartridge 1 has some degree of runout, the bullet 2 will be misaligned with the central axes of the breach and rifle bore when the cartridge 1 is introduced into the breach. When a cartridge with some degree of runout is fired in a rifle, the bullet 2 will travel down the rifle bore maintaining its misaligned condition as it travels. When the misaligned bullet 2 exits the muzzle of the rifle and flies through the air, the bullet 2 will spin or rotate around an axis which is different than the longitudinal central axis of the bullet 2. In other words, the bullet 2 will wobble as it flies through the air. This wobble or misalignment in flight causes the bullet to fly off target or deviate from its intended straight line path.

Since typical grade ammunition is manufactured with some degree of runout, there is a need for a rifle bore configuration which aligns the bullet as it travels down the rifle bore.

SUMMARY OF THE INVENTION

The present invention is a rifle bore configuration that realigns a bullet as it travels from the breach to the muzzle to ensure that bullets leaving the muzzle spin perfectly without any wobble.

According to one aspect of the invention, there is provided a rifle barrel for realigning a projectile which is propelled through the barrel by gas pressure, the barrel comprising: a bore having a bore diameter through which a projectile may travel; rifling ridges within the bore; and at least one bore expansion chamber in the bore, wherein a diameter of the at least one bore expansion chamber is greater than the bore diameter, wherein a length of the at least one expansion chamber is smaller than an overall length of the projectile and greater than a contact length of the projectile.

According to a further aspect of the invention, there is provided a means of increasing the accuracy of the bullet by purposefully allowing gases to explode past the bullet in order to realign the bullet.

According to still another aspect of the invention, there is provided a process for manufacturing a runout correction rifle barrel, the process comprising: inserting a bore cutting tool into a constant diameter rifle bore; engaging a cutter of the bore cutting tool with a bore of the rifle barrel; and moving the bore cutting tool to remove a portion of the rifle barrel from the bore.

According to a further aspect of the invention, there is provided a process for projecting a projectile from a rifle barrel, the process comprising: increasing gas pressure behind the projectile in the rifle barrel, whereby the projectile is propelled through the rifle barrel; and passing a burst of gas around the projectile, whereby the projectile is aligned coaxially in the rifle barrel.

BRIEF DESCRIPTION OF THE DRAWINGS

The present invention is better understood by reading the following description of non-limitative embodiments with reference to the attached drawings wherein like parts in each of the several figures are identified by the same reference characters, and which are briefly described as follows.

It is to be noted, however, that the appended drawings illustrate only typical to embodiments of this invention and are therefore not to be considered limiting of its scope, as the invention may admit to other equally effective embodiments.

DETAILED DESCRIPTION OF THE INVENTION

Figure 1A:
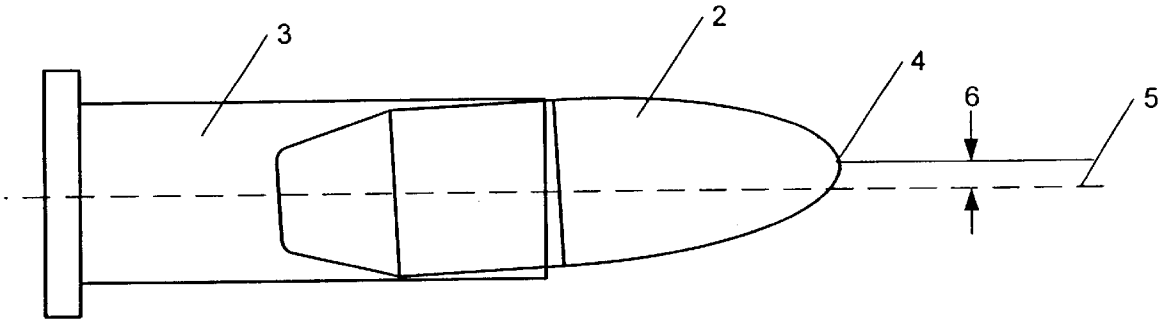
FIG. 1A is a side view of a cartridge having a casing and bullet, wherein the bullet is misaligned in the casing.
Figure 1C:
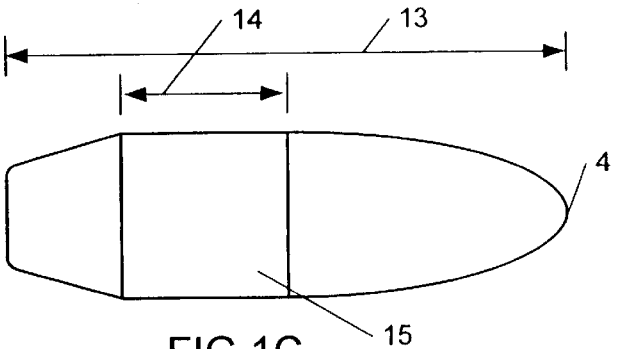
FIG. 1C is a side view of a bullet.
Figure 1B:
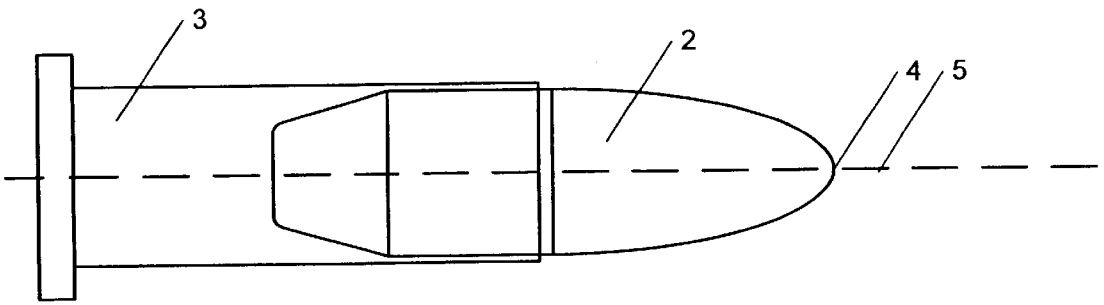
FIG. 1B is a side view of a cartridge having a casing and bullet, wherein the bullet is aligned properly in the casing.
Figure 2A:
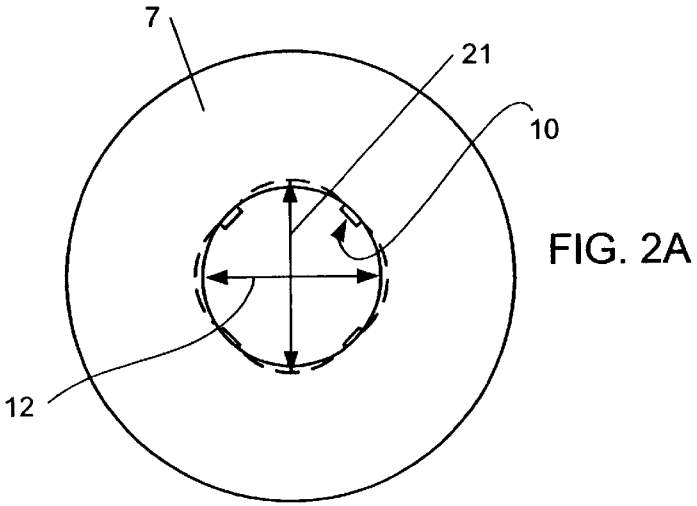
FIG. 2A is an end view of a section of a barrel of a gun, wherein the rifle bore has a bore expansion chamber.
Figure 2B:
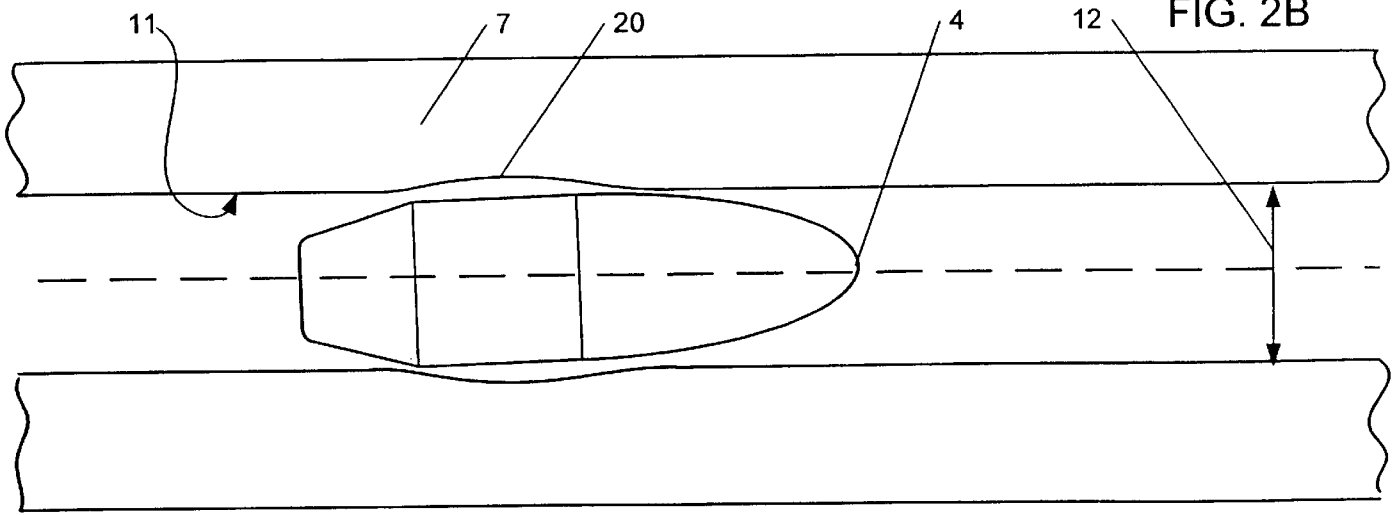
FIG. 2B is across-sectional side view of a section of a barrel of a gun having a bore expansion chamber and a bullet passing through the bore expansion chamber.
Figure 4:
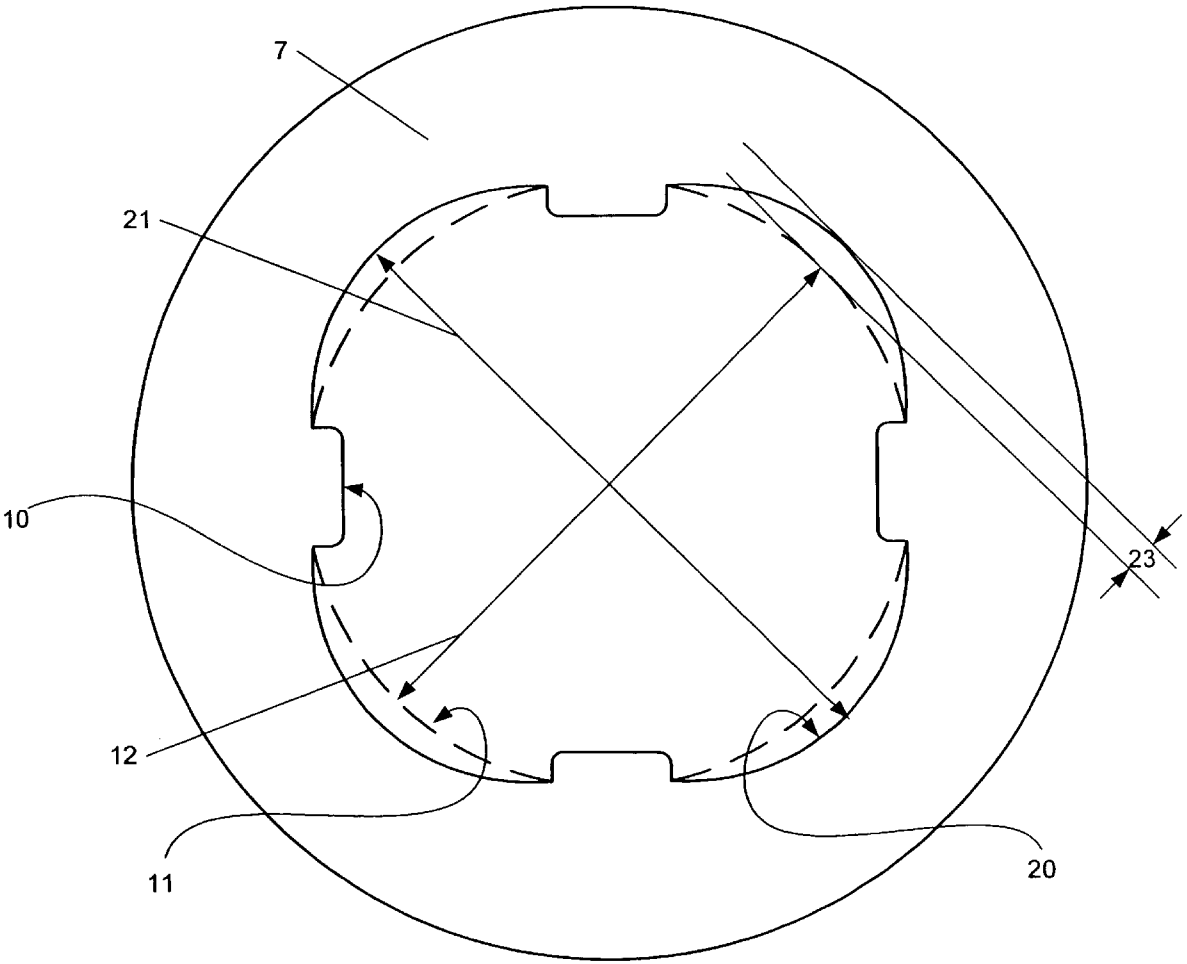
FIG. 4 is a cross-sectional end view of a section of a rifle barrel having a bore expansion chamber and four rifling ridges.
Figure 5:
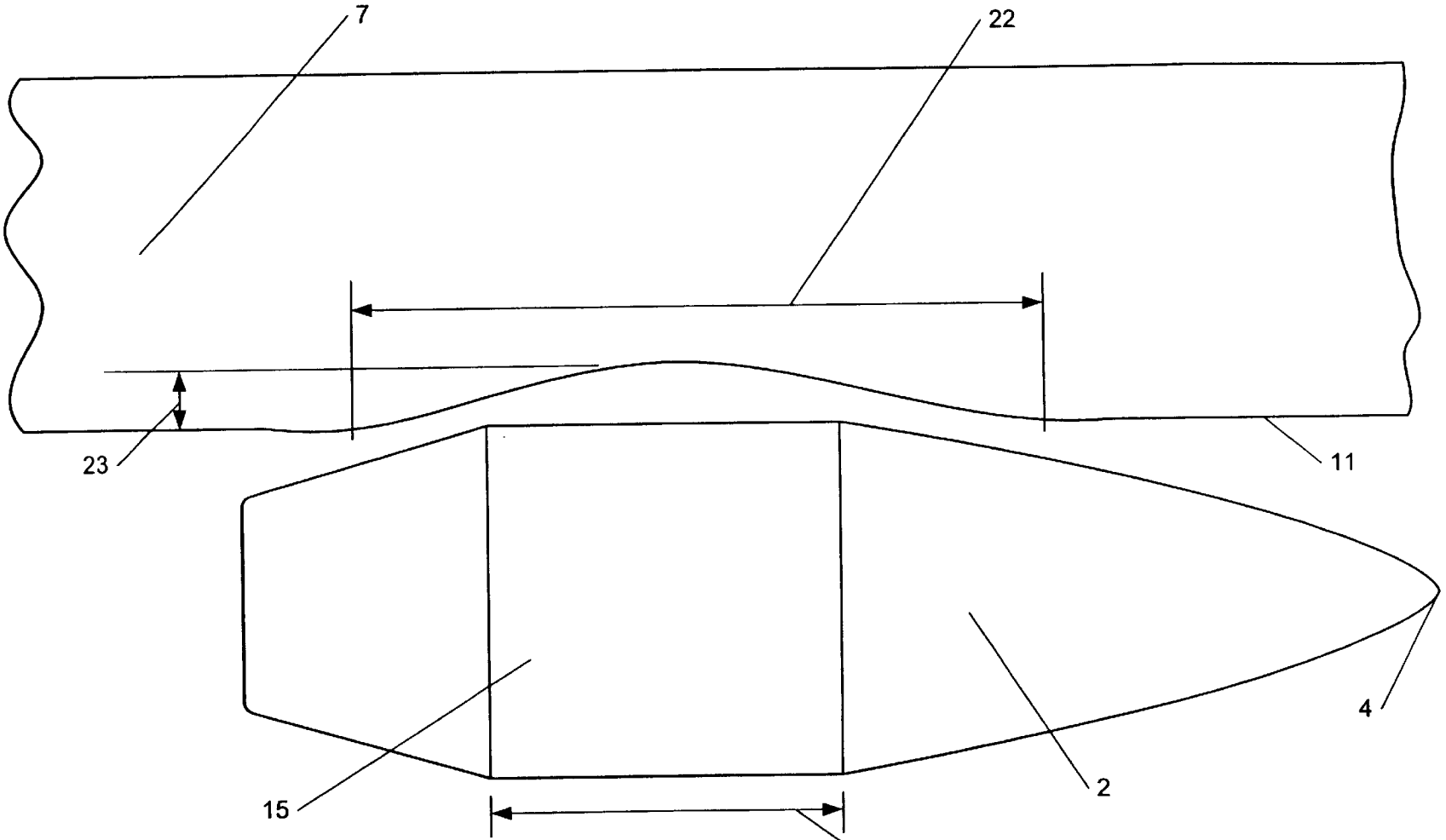
FIG. 5 is a cross-sectional side view of a bore expansion chamber section of a rifle barrel and a bullet in the bore expansion chamber.

Referring to FIGS. 2A and 2B, end and side views of an embodiment of the invention are shown for a rifle barrel 7, respectively. Reference is also made to FIGS. 4 and 5, wherein FIG. 4 is a cross-sectional end view of a bore expansion chamber 20 and FIG. 5 is a cross-sectional side view of a portion of a bore expansion chamber 20. Rifling 10 comprises a ridge which extends from the bore 11 of the rifle barrel 7 and spirals over at least a portion of the length of the rifle barrel 7. In the embodiment shown, there are four rifling ridges 10 which spiral down the inside of the bore 11. The barrel 7 has a bore diameter 12 which is approximately the same or slightly less than the outside diameter of the bullet 2. The barrel 7 also has at least one distinct bore expansion chamber 20 along its length. The bore expansion chamber 20 has a chamber diameter 21 that is greater than the bore diameter 12. The bore expansion chamber 20 has a chamber length 22 that is less than the overall length 13 of the bullet 2, and preferably just longer than the bullet contact length 14 (see FIG. 1C). The bore expansion chamber 20 functions to allow a short pulse of gases to explode past the bullet 2 as the bullet 2 travels through the bore expansion chamber 20. The explosive gases passing by the bullet 2 produce relatively higher and lower pressures on the bullet tip 4, depending on the alignment of the bullet 2 in the bore 11. If the bullet 2 is misaligned as shown in FIG. 2B, the explosive gases passing over the top (as oriented in the figure) of the bullet tip 4 will induce more pressure on the bullet tip 4 than the explosive gases passing over the bottom of the bullet tip 4. This unequal pressure distribution imparts a force to the bullet 2 to realign the bullet to be coaxial with the bore 11.

Figure 3:
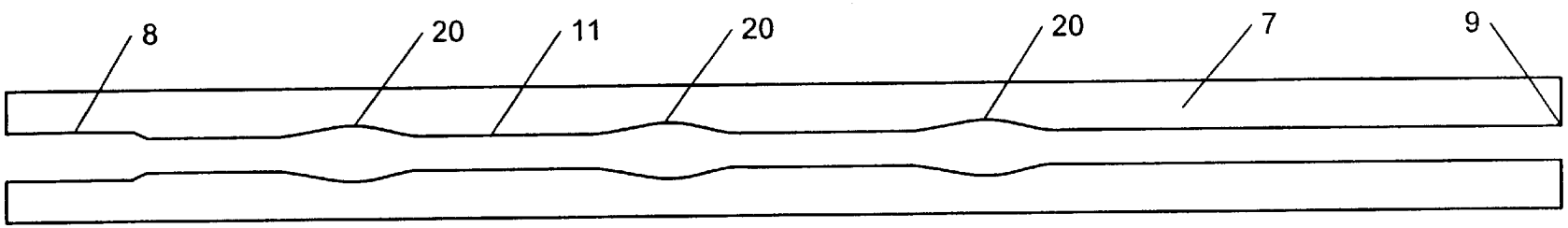
FIG. 3 is a cross-sectional side view of a rifle barrel having three bore expansion chambers of the present invention.

Referring to FIG. 3, a side view of an embodiment of the invention is shown for a gun barrel 7. In this embodiment, the barrel 7 is a rifled bore from the breach 8 to the muzzle 9, similar to the embodiment shown in FIGS. 2A and 2B. This embodiment has three bore expansion chambers 20 in the barrel 7. If the bore expansion chamber 20 first encountered by the bullet (not shown) does not fully align the bullet traveling down the bore 11, the second and third bore expansion chambers 20 will further correct the alignment. According to further embodiments of the invention any number of alignment zones are employed along the bore 7, depending upon the particular application and severity of the runout 6 in the ammunition. In preferred embodiments of the invention, a bore expansion chamber 20 is not formed in the bore 11 too close to the breach 8 or to the muzzle 9. The bullet 2 needs enough space between the breach 8 and the first bore expansion chamber 20 to stabilize in the bore 11 and rifling 10. Similarly, the bullet 2 needs enough space between the last encountered bore expansion chamber 20 and the muzzle 9 for the bullet to stabilize prior to exiting the muzzle. In most rifle barrels 7, it is preferred to provide about 6 inches of space between the breach 8 and the first bore expansion chamber 20 and between the last bore expansion chamber 20 and the muzzle 9.

Referring to FIG. 4, a cross-sectional end view, similar to FIG. 2A, of a bore expansion chamber is shown. In this embodiment of the invention, the bore 7 has four rifle ridges 10. A dotted line shows where the surface of the bore 11 would normally be if there was not a bore expansion chamber 20. As is known in the art, the bore diameter 12 defines the caliber of the rifle and the size of the bullets fired through the barrel 7. The bore expansion chamber 20 has a chamber diameter 21 which is greater than the bore diameter 12. While the chamber diameter 21 may be any size which does not compromise the integrity of the barrel 7, it is preferred that the chamber diameter 21 be about one hundred fifteen percent (115%) the caliber or bore diameter 12. In one embodiment of the invention, the chamber depth 23 is calculated as follows:

$$(\text{caliber}(\text{caliber}+(\text{caliber}/100)))/2=\text{chamber depth}$$

For example, if the caliber is 0.308 inches, the chamber depth 23 is calculated as follows:

$$(0.308(0.308+(0.308/100)))/2=0.0479 \text{ inches}$$

As a further example, if the caliber is .223, the chamber depth 23 is calculated as follows:

$$(.223(.223+(.223/100)))/2=0.0251 \text{ inches}$$

This basic formula is used to approximate the chamber depth 23 for any caliber rifle. To obtain the chamber diameter 21, simply add two times the chamber depth 23 to the caliber or bore diameter 12.

Referring to FIG. 5, a side view of a portion of a rifle bore of the present invention is shown with a bullet 2 in a position of traveling down the rifle bore 11 in the vicinity of a bore expansion chamber 20. The bullet 2 has a cylindrical mid-section called a contact patch 15 which contacts the rifle bore 11 (see also FIG. 1C). This contacting portion of the bullet has a bullet contact length 14. Bullets typically have a contact length 14 that is about 30% the overall length 13 of the bullet 2 and only in rare cases is the contact length 14 more than about 50% the overall length 13 of the bullet 2. The bore expansion chamber 20 has a chamber length 22 which is related to the bullet contact length 14 according to the following expression:

bullet contact length+(caliber/100)=chamber length

For example, if the caliber is 0.308 inches and the bullet contact length is 0.250 inches, the chamber length is calculated as follows:

0.250+(0.308/100)=0.2531 inches

As a further example, if the caliber is .223 and the bullet contact length is 0.125 inches, the chamber length is calculated as follows:

0.125+(.223/100)=0.1272 inches

The most important aspect of designing the size and shape of the bore expansion chamber is to consider the size of the gaps between the bullet and the bore expansion chamber. Exploding gases only have the opportunity to blast past the bullet 2 for a very short period of time, when the contact patch 15 of the bullet 2 is in the middle of the bore expansion chamber 20. In this position, a gap develops between the leading edge of the contact patch 15 and the bore expansion chamber 20 and a second gap develops between the trailing edge of the contact patch 15 and the bore expansion chamber 20. The amount of exploding gas which passes around the bullet 2 is determined by the size of these gaps. The gaps are made larger by increasing the chamber depth 23, the chamber length 22 or both. Further, in the embodiments of the invention illustrated in the figures, the profile of the bore expansion chamber has a smoothly sloping contour. Alternative embodiments of the invention have a stair step or squared off contour so as to increase the size of the gaps without increasing the overall chamber depth or chamber length. Embodiments that have a squared off or stair step profile tend to create a turbulent flow of the exploding gases around the bullet which is less desirable.

Referring to FIG. 5, a bullet with approximately known qualities of length and diameter is propelled through the barrel. As a bullet or projectile is fired, it travels along the barrel, and makes contact with the bore 11 and the rifling ridges 10. The projectile is pushed along the barrel 7 by the explosive gases released during firing. Until the projectile reaches a bore expansion chamber, the amount of gas that bypasses the projectile is relatively lower than what will bypass the projectile when it reaches the bore expansion chamber.

The bore expansion chamber is an area of the barrel where the interior diameter of the bore is greater than the interior diameter in the adjoining narrow bore areas. Between the time the projectile passes the chamber start and the chamber end, a burst of explosive gases is allowed to bypass the projectile. This burst of gas helps to focus the path of the projectile. The bore expansion chamber does not change the rifling pattern or rifling diameter. The bore expansion chamber 20 is just longer than the length of the projectiles contact patch 15. The chamber start is the location along the barrel where the diameter begins an increase from that of adjoining area preceding the chamber. The chamber end is the location along the barrel where the diameter narrows to that of the adjoining bore. Either the start or the end may consist of transition surfaces which depart from the adjoining narrow bore surfaces at a departure angle with discontinuities between the surfaces. In an alternate embodiment, there are no transition surfaces or discontinuities, and the chamber surface flows smoothly from the chamber start to the chamber end. The chamber surface may be generally straight, or it may form a curved surface.

Figure 6A:
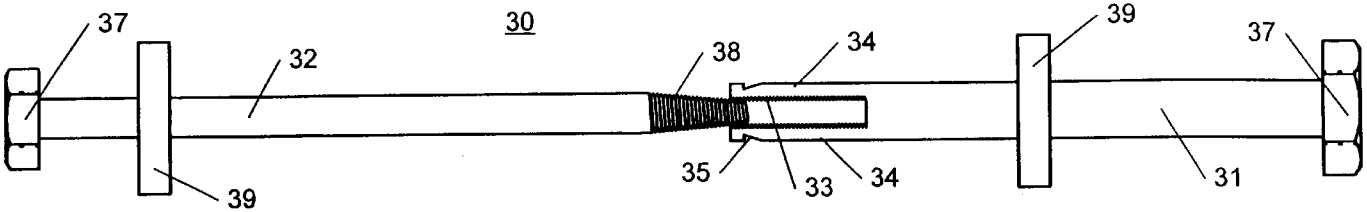
FIG. 6A is a side view of a bore cutting tool for cutting a bore expansion chamber in a rifle bore.
Figure 6B:
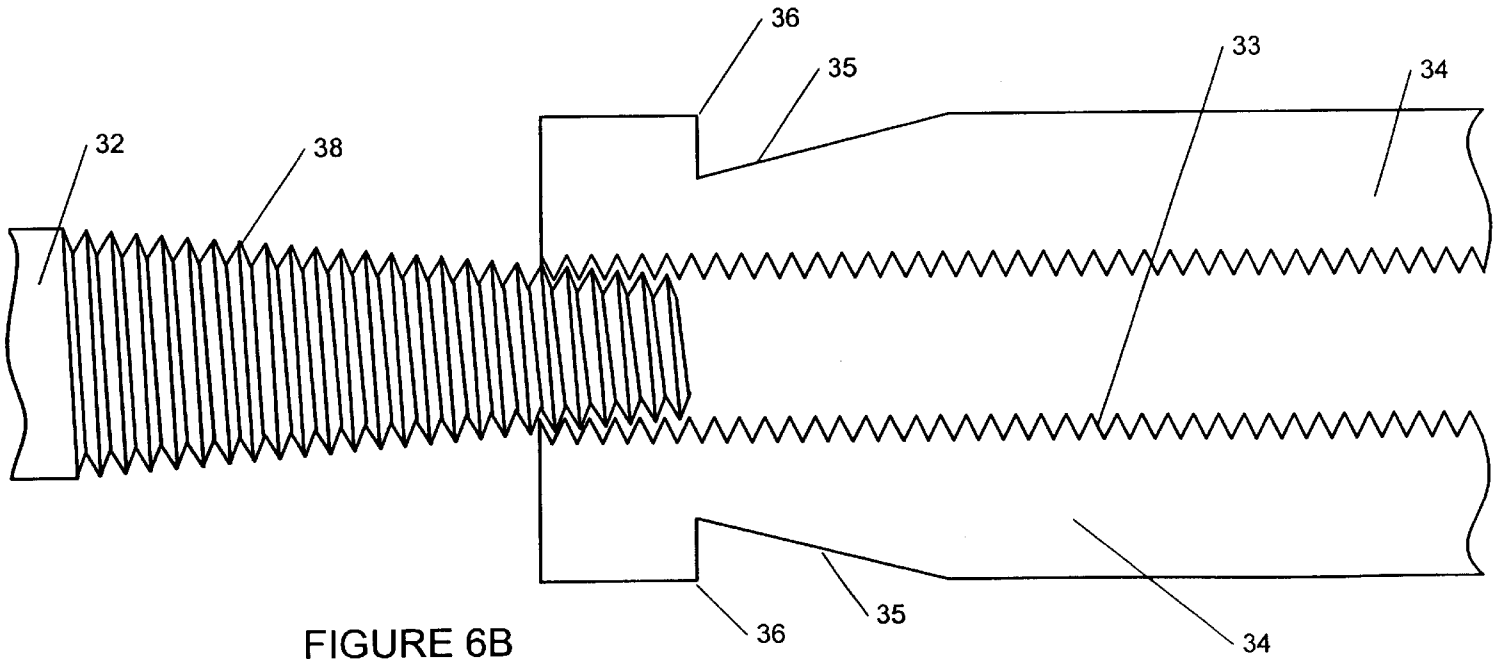
FIG. 6B is a side view of the cutting components of the cutting tool shown in FIG. 6A.

A rifle barrel 7 of the present invention is manufactured by modifying gun barrels having rifled bores which are widely available on the market today and known to persons of skill in the art. The rifle barrel is secured in a vise or some other mechanism to stabilize the barrel. A bore cutting tool 30, as shown in FIGS. 6A and 6B, is then used to cut the bore expansion chamber 20. The bore cutting tool 30 is comprised of two main components, a cutter rod 31 and an expander rod 32. FIG. 6A is a side view of the cutter rod 31 and the expander rod 32 wherein the rods are mating. FIG. 6B is a close-up view of the cutting portion of the rods shown in FIG. 6A. The cutter rod 31 is a cylindrical rod with female threads 33 on the inside. Opposing fingers 34 are formed in the distal end of the rod, wherein the portions of the rod between the fingers 34 are removed to allow the fingers 34 to be spread in opposite directions away from each other. Each finger 34 has a notch 35 in its exterior surface. The notch 35 forms a cutting edge 36 which is what is used to cut a bore expansion chamber in a barrel. The cutter rod 31 also has a hex head 37 or some other device for gripping the rod at its proximal end. The expander rod 32 has tapered male threads 38 at its distal end and a hex head 36 or some other device for gripping the rod at its proximal end. Both the cutter rod 31 and the expander rod 32 have a lock ring 39 which is positionable on the shanks of the rods. Once a position on the shank is selected, the lock ring 39 may be locked in place on the shank of the rod. The lock rings 39 comprises any locking mechanism which is known to persons of skill in the art.

The bore cutting tool 30 is used to cut a bore expansion chamber 20 in a rifled bore by inserting the cutter rod 31 into one end of the bore and inserting the expander rod 32 into the opposite end of the bore. For illustration, assume that the cutter rod 31 is inserted into the muzzle end and the expander rod 32 is inserted into the breach end. A measurement is taken to determine how far into the bore the bore expansion chamber is to be cut from the muzzle end. The lock ring 38 on the cutter rod 31 is locked in place on the shank of the cutter rod 31 so that the cutting edges 36 extend to the side of the intended bore expansion chamber 20 opposite from the muzzle 9. The cutter rod 31 is then inserted into the muzzle end of the bore until the lock ring 39 contacts the muzzle. The expander rod 32 is then inserted into the breach end of the bore until the tapered male threads 38 engage the female threads 33 of the cutter rod 31. The expander rod 32 is then rotated to thread into the cutter rod 31 to spread the fingers 34 apart until the cutting edges 36 contact the bore. The chamber length 22 is then calculated according to the formula above and the expander rod lock ring 39 is fixed on the shank of the expander rod at a distance from the breach 8 equal to the calculated chamber length 22. The assembled bore cutting tool is then oscillated back and forth to allow the cutting edges 36 to cut the bore expansion chamber. The lock rings 39 are then released, moved slightly closer to the gun barrel, and reset. The expander rod 32 is then threaded slightly further into the cutter rod 31. Again, the bore cutting tool 30 is oscillated back and forth to cut a deeper portion in the middle of the bore expansion chamber. Once this section of the bore expansion chamber is cut, the rods are removed from the bore. The cutter rod is rotated so that the fingers 34 line up with another section of the bore between the rifling ridges 10 and the cutter rod 32 is reinserted into the bore 11. The steps of the process outlined above are then repeated until all of the sections between the rifling ridges 10 are cut at the same depth.

It is preferred that the width of the cutting edge 36 is just slightly smaller than the distance between the rifling ridges 10 for the particular rifle bore being cut.

In alternative embodiments of the bore cutting tool 30, there are more than two fingers 34. In fact, the number of fingers 34 may coincide with the number of spaces between rifling ridges for the particular rifle bore being cut. In these embodiments, the rods only need to be inserted into the bore one time to cut a bore expansion chamber.

Some embodiments of the invention comprise a bore expansion chamber which does not have all of the spaces between the rifling ridges cut, but in all embodiments, the chamber should be symmetrical.

While the particular embodiments for gun barrels as herein shown and disclosed in detail are fully capable of obtaining the objects and advantages hereinbefore stated, it is to be understood that they are merely illustrative of the preferred embodiments of the invention and that no limitations are intended by the details of construction or design herein shown other than as described in the appended claims.

What is claimed is:

1. A rifle barrel for realigning a projectile which is propelled through the barrel by gas pressure, said barrel comprising:

a bore having a bore diameter and a bore length through which a projectile may travel which has an overall projectile length which is less than the bore length and a contact length that is less than the overall projectile length; and rifling ridges within said bore to contact a projectile along the contact length and rotate the projectile within the bore;

at least one bore expansion chamber within said bore, wherein a diameter of at least one bore expansion chamber is greater than the bore diameter, wherein the at least one bore expansion chamber has a length that is smaller than the bore length, smaller than the overall projectile length, and greater than the contact length of the projectile, and wherein the bore expansion chamber is free of the rifling ridges.

2. The rifle barrel of claim 1, wherein said at least one bore expansion chamber comprises a plurality of bore expansion chambers in said bore.

3. The rifle barrel of claim 1, wherein the at least one bore expansion chamber is more than three projectile lengths from a muzzle of said barrel.

4. The rifle barrel of claim 1, wherein the length of said bore expansion chamber is between about 101% and 110% of the contact length of the projectile.

5. The rifle barrel of claim 1, wherein a maximum diameter of said at least one bore expansion chamber is between about 101% and about 115% of the bore diameter.

6. The rifle barrel of claim 1, wherein said at least one bore expansion chamber comprises a smoothly transitioning surface from a start to an end of said at least one bore expansion chamber.

7. The rifle barrel of claim 1, wherein more than one of the chamber diameters of said at least one bore expansion chamber are greater than the bore diameter.

8. The rifle barrel of claim 1, wherein all of the chamber diameters of said at least one bore expansion chamber are greater than the bore diameter.

9. A rifle for improved runout correction of a bullet fired by the rifle, the rifle comprising a rifle barrel having a muzzle and a breech, the rifle barrel comprising:

a bore having a bore diameter and through which a projectile may travel from breech to muzzle;

a bore expansion chamber in said bore to align a bullet traveling down the bore, the bore expansion chamber having a diameter that is greater than the bore diameter; and a plurality of radially inwardly projecting rifling ridges disposed in a spiral pattern along the bore, the spiral pattern of the rifling ridges being free of the bore expansion chamber.

10. The rifle of claim 9 wherein there are a plurality of bore expansion chambers along the bore.

11. The rifle of claim 9 wherein the bore provides a circular circumference and the bore expansion chamber has a larger diameter upon substantially the entire circular circumference of the bore.

12. The rifle of claim 9 wherein the distance from the muzzle to the bore expansion chamber is not less than six inches.

13. The rifle of claim 9 wherein the distance from the breech to the bore expansion chamber is not less than six inches.

14. The rifle of claim 9 wherein the diameter of the bore expansion chamber is between about 101% and about 115% of the bore diameter.

15. The rifle of claim 9 wherein the bore expansion chamber comprises a smoothly transitioning surface from a start to an end of the bore expansion chamber.

16. A rifle and projectile combination comprising:

a rifle having a rifle barrel comprising:

a bore extending from a muzzle to a breech, the bore having a bore diameter and through which a projectile may travel from breech to muzzle;

a bore expansion chamber in said bore to align a bullet traveling down the bore, the bore expansion chamber having a diameter that is greater than the bore diameter;

a plurality of radially inwardly projecting rifling ridges disposed in a spiral pattern along the bore, the spiral pattern of the rifling ridges being free of the bore expansion chamber a projectile for traveling along the bore of the rifle, the projectile having a projectile length and a contact patch that contacts the rifling ridges and the bore as the projectile travels along the bore, the contact patch having a contact length.

17. The rifle and projectile combination of claim 16 wherein the bore expansion chamber has a length that is smaller than the projectile length and greater than the contact length.

18. The rifle and projectile combination of claim 16 wherein the length of the bore expansion chamber is between 101% and 115% of the contact length.

19. The rifle and projectile combination of claim 16 wherein the bore expansion chamber is more than three projectile lengths from the breech and more than six inches from the muzzle.

20. The rifle and projectile combination of claim 16 wherein the projectile has a caliber and the bore expansion chamber has a chamber depth that is related to the caliber by the following equation:

$$(\text{caliber}(\text{caliber}+(\text{caliber}/100)))/2=\text{chamber depth}.$$

* * * * *